United States Patent [19]

Benshoof

[11] Patent Number: 4,825,490

[45] Date of Patent: May 2, 1989

[54] AUTOMATIC TOILET FLUSHING APPARATUS

[76] Inventor: Mervin C. Benshoof, 3165 Mush Bluff Rd., Box 11, St. Marys, Ga. 31558

[21] Appl. No.: 119,558

[22] Filed: Nov. 12, 1987

[51] Int. Cl.[4] ..... E03D 1/00; E03D 5/04

[52] U.S. Cl. ..... 4/313; 4/407; 4/408

[58] Field of Search ..... 4/313, 345, 251, 330, 4/408, 409, 407

[56] References Cited

U.S. PATENT DOCUMENTS

| | | | |
|---|---|---|---|
| 429,879 | 6/1890 | Blondel | 4/407 |
| 547,503 | 10/1895 | Scott | 4/407 |
| 4,617,687 | 10/1986 | Wadsworth | 4/213 |

FOREIGN PATENT DOCUMENTS

| | | | |
|---|---|---|---|
| 470903 | 4/1952 | Italy | 4/407 |

*Primary Examiner*—Henry J. Recla
*Assistant Examiner*—Ed Donovan
*Attorney, Agent, or Firm*—Richard C. Litman

[57] ABSTRACT

A simple, lightweight device for the automatic flushing of a toilet which works on the principle of displaced air is disclosed. An air bag disposed between the seat and the rim of the toilet bowl communicates with a bellows vertically disposed within the flush tank. A shaft depending from said bellows rises and falls with the contraction and expansion thereof. An angled member pivotally attached to said shaft is caused to rotate by guide means in one direction as the shaft falls, and in the other direction as the shaft rises. In so doing, it first engages, then unseats, then releases the flush tank drain valve apparatus.

5 Claims, 3 Drawing Sheets

AUTOMATIC TOILET FLUSHING APPARATUS

BACKGROUND OF THE INVENTION

1. FIELD OF THE INVENTION

This invention relates to toilets and specifically to flushing means for toilets. More particularly, this invention relates to automatic flushing means for toilets which are actuated by the user sitting on the toilet seat then arising therefrom.

2. DESCRIPTION OF THE PRIOR ART

Manual flushing devices for toilets are of course well known. However, these have the disadvantage that people, especially elderly people and children, occasionally forget to use them, with resulting unpleasantness and possible disease hazard.

Accordingly, several devices have been provided for automatically flushing a toilet when the user sits down and arises from the toilet seat. Illustrative of these prior art devices are U.S. Pat. No. 3,056,142 to Chin, and Nos. 4,329,745 and 4,443,898 to Aguero.

U.S. Pat. No. 3,056,142 to Chin discloses a mechanism utilizing a spring-loaded toilet seat and two cam assemblies. U.S. Pat. Nos. 4,329,745 and 4,443,898 to Augero utilize an elongated lever arm extending from the toilet seat to a vertical actuating link. When the user sits down on the toilet seat, this vertical actuating link is pushed upwardly and engages a flush valve actuating mechanism, which then causes the toilet to flush when the user arises.

Each of these prior art devices has the disadvantage of comprising several moving mechanical parts with a resultant increased likelihood of breakdown. Each has the further disadvantage of being relatively heavy, expensive to produce, and difficult to install.

SUMMARY OF THE INVENTION

Accordingly, it is an object of the present invention to provide a simple., lightweight device for the automatic flushing of toilets that is inexpensive to produce, easy to install, and which consists of a minimum number of moving parts.

It is a further object of the present invention to produce such a device which works on the principle of displaced air.

Still a further object of the present invention to produce such a device which can be manufactured entirely from lightweight plastic.

Another object of the present invention to provide such a device which can be readily installed without modification of existing flush mechanisms in toilets having either ball-and-rod type flush valves or flapper-type flush valves.

Still a further object of the present invention to provide such a device which will allow the toilet to be manually flushed by conventional means when the seat is not used.

In the present invention, an air bag disposed between the commode and the commode seat communicates by means of an air hose with a bellows disposed vertically within the flush tank. The bellows is preferably contained within a cylindrical housing and anchored to the top thereof. Depending from the bellows is a vertical shaft having a longitudinal channel. Pivotally mounted within this channel is a crank having an upper arm and a lower arm offset from each other at a shallow angle. At the end of the lower arm is a forked member. When the user sits on the toilet, air is displaced from the air bag to the bellows, causing it to expand. As the bellows expands, the vertical shaft descends through an aperture in the bottom of the housing. As the shaft descends, the upper arm of the crank encounters the edge of the aperture, which urges it toward axial alignment with the vertical shaft within the longitudinal channel. As this occurs, the lower arm rotates outward and the forked member engages the flush ball rod. When the user arises from the toilet seat, the bellows contracts, aided by water pressure within the tank and the tendency of the air bag to resume its normal shape. With the concurrent rising of the vertical shaft, the crank unseats the flush valve member and with further rising of the shaft, the bottom arm of the crank encounters the bottom edge of the aperture in the bottom of the housing and is urged toward axial alignment with the vertical shaft. As this occurs, the crank releases the flush valve, which then reseats after the toilet has finished flushing.

DESCRIPTION OF THE PREFERRED EMBODIMENT

The present invention will be better understood, and its advantages more readily appreciated, from the following detailed description of a preferred embodiment. This description makes reference to the accompanying drawings, in which similar reference character designate corrresponding parts throughout the several views and wherein.

Figure 1:
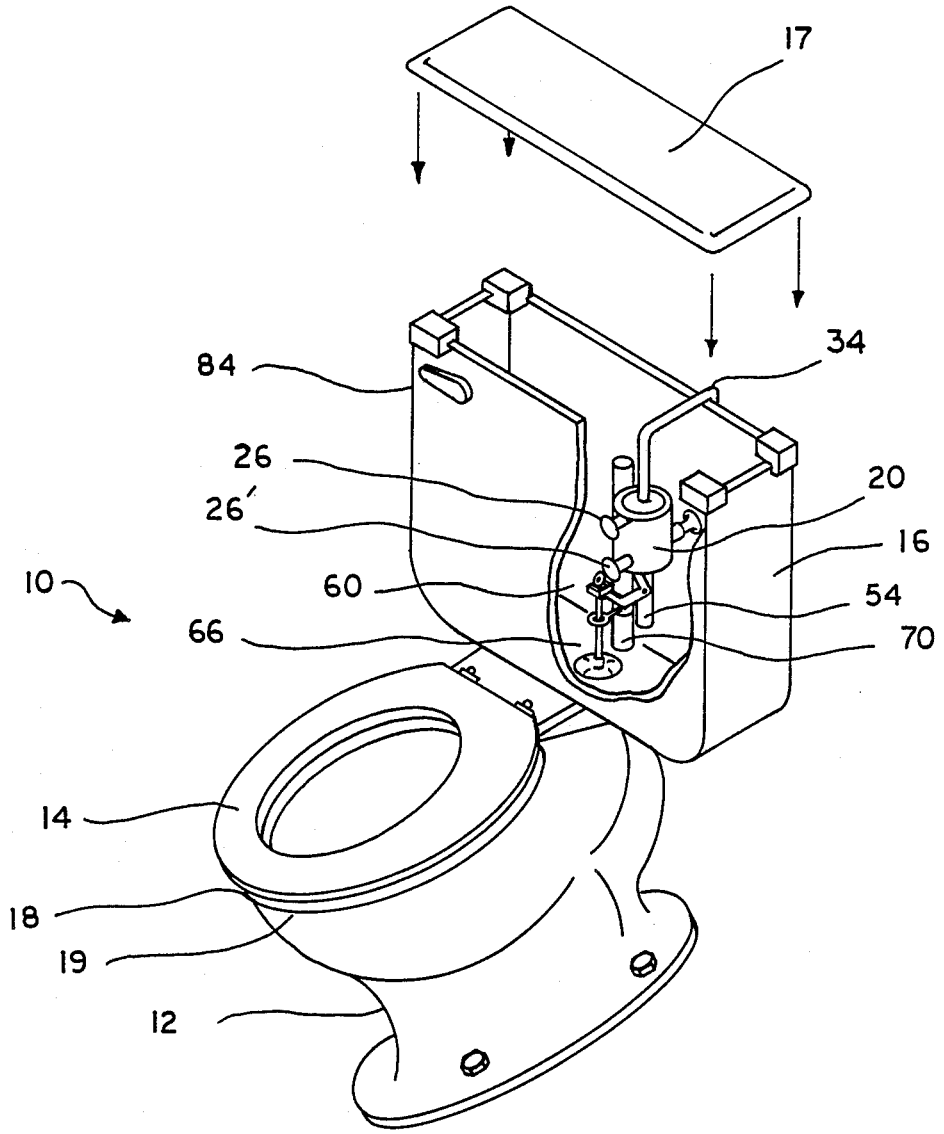
FIG. 1 is a perspective side elevational view of a toilet and flush tank with the device of the present invention installed.

Referring now to the drawings, FIG. 1 shows a conventional toilet 10 having a commode 12, a commode seat 14, a flush tank 16 and a flush tank cover 17. At the bottom of flush tank 16 is flush tank drain 78. Seated in flush tank drain 78 is a conventional drain valve assembly 64 of the ball-and-rod type and which comprises a ball valve 68, flush rod 66, and eye hook 72.

According to the present invention, there is disposed between the rim 19 of commode 12 and commode seat 14 an air bag 18, which is preferably affixed to the underside of commode seat 14 by suitable adhesive means. Air bag 18 is preferably of the type which tends to resume its shape when pressure is equalized therein.

Air hose 34 runs from air bag 18 to an automatic flushing apparatus 20, which is vertically disposed within flush tank 16. As can be more clearly seen in FIG. 2, flushing apparatus 20 comprises a bellows 22 vertically disposed within a cylindrical housing 24 which is in turn anchored within flush tank 16 by anchoring arms 26, 26', 28 and 28'. Anchoring arms 26 and 26' are preferably spring-loaded, while arms 28 and 28' feature screw-type adjustment means to enable the horizontal position of automatic flushing apparatus 20 to be easily adjusted.

The air hose 34 from the bag 18 passes through aperture 33' in top plate 32 of housing 24 and is joined to the top of bellows 22. Air bag 18, air hose 34, and bellows 22 thus form a closed system. When air bag 18 is compressed, as by a user sitting on seat 14, bellows 22 expands. Conversely, when pressure is released from air bag 18, as by said user arising, bellows 22 contracts, aided by the tendency of air bag 18 to resume its original shape and by the effect of water pressure within the flush tank 16. Cylindrical housing 24 may be furnished with holes or slots 25 to enable water to flow readily in and out.

The top 32 of bellows 22 is anchored to the top plate 32 of cylindrical housing 24 by suitable means. Bellows 32 and housing 24 are axially offset somewhat from the axis of flush ball rod 66.

Threadedly secured to the base 36 of bellows 22 is vertical shaft 54, which passes through aperture 40 in bottom plate 38 of housing 24. Vertical shaft 54 has a longitudinal channel 42 which is aligned with flush ball rod 66. Pivotally mounted within longitudinal channel 42 is crank 56, which has an upper arm 57 and a lower arm 59 forming an obtuse angle. At the distal end of lower arm 59 is a forked member 60 comprising two tines **60*a* and 60*b***.

Seated in drain 78 is conventional drain valve assembly 64 comprising ball valve 68, rod 66 and eye hook 72. Fixed to rod 66 at the base of eye hook 72 is stop means **72*a*, which may comprise a washer having an inner gasket with an aperture whose diameter is less than that of rod 66 so that it does not slide downwardly thereon. Said washer may be disher upwardly so that it does not adhere to tines 60*a* and 60*b***.

In operation, when a user sits on commode seat 14, air is forced from air bag 18 through air hose 34 into bellows 22, causing bellows 22 to expand downwardly. As vertical shaft 54 descends, upper arm 57 of crank is urged by upper edge 44 of aperture 40 toward axial alignment with vertical shaft 54. Lower arm 59 is thereby caused to rotate outwardly, causing forked member 60 to engage flush rod 66. As the user arises from commode seat 14, bellows 22 contracts, causing vertical shaft 54 to ascend. As this occurs, stop means **72*a* remains captive between tines 60*a* and 60*b* of forked member 60, causing ball valve 68 to unseat. As vertical shaft 54 continues to ascend, lower arm 59 of crank 56 is urged by the lower edge 46 of aperture 40 toward axial alignment with vertical shaft 54, thereby releasing flush valve apparatus 64**, which then reseats in the usual manner.

Figure 2:
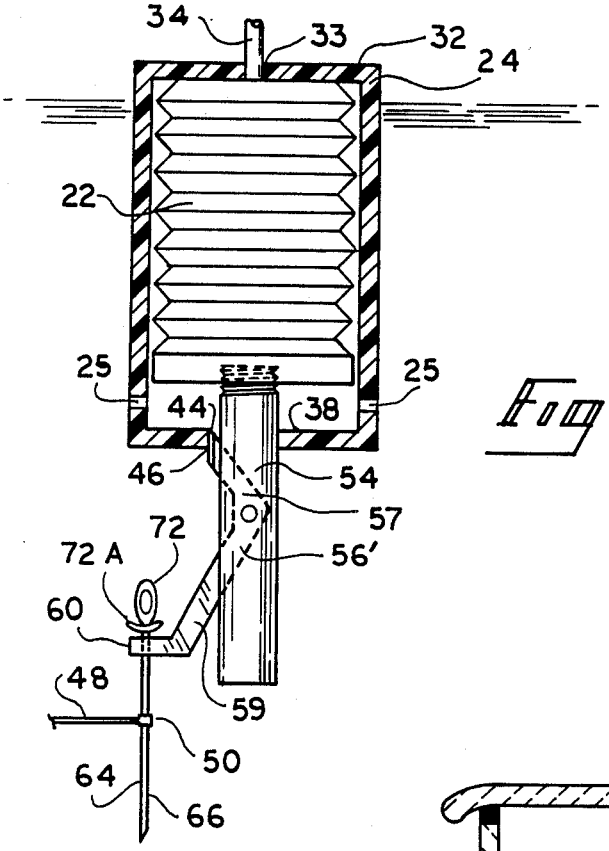
FIG. 2 is a side view of the present invention installed in a conventional flush tank.
Figure 3:
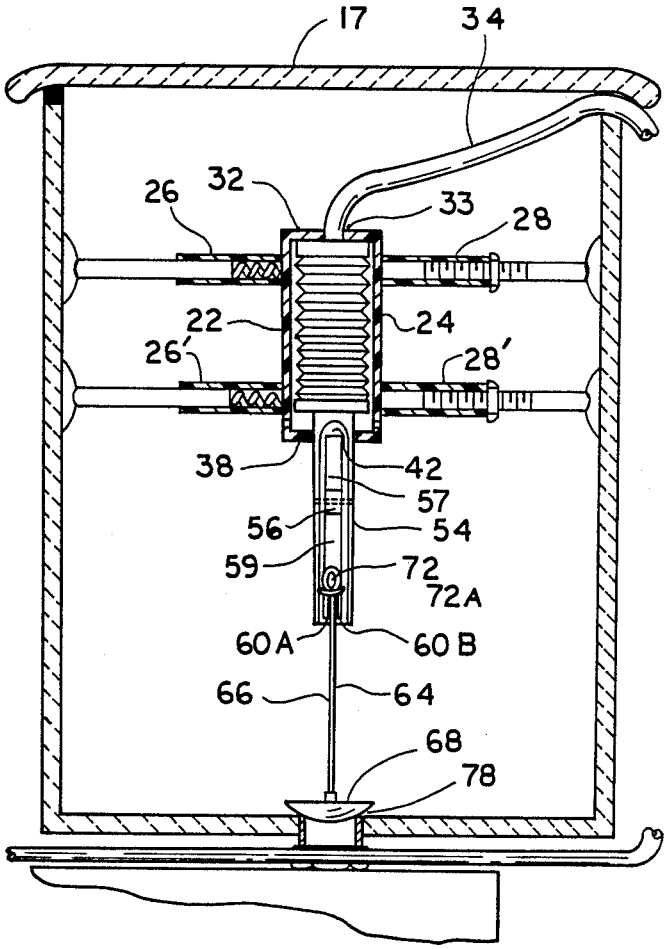
FIG. 3 is a front view of the present invention installed in a conventional flush tank.

As shown in FIG. 2, in most toilets employing a flush valve apparatus of the ball-and-rod type, there is furnished a guide arm 48 having a tubular member 50 at the end thereof to ensure that the flush valve apparatus reseats properly after the toilet is flushed. Absent such a mechanism, as shown in FIG. 4, housing 24 may be furnished with an L-shaped extension 55 having a tubular member **55*a*** at the end thereof to ensure that the flush valve apparatus reseats properly after the toilet is flushed.

Figure 4:
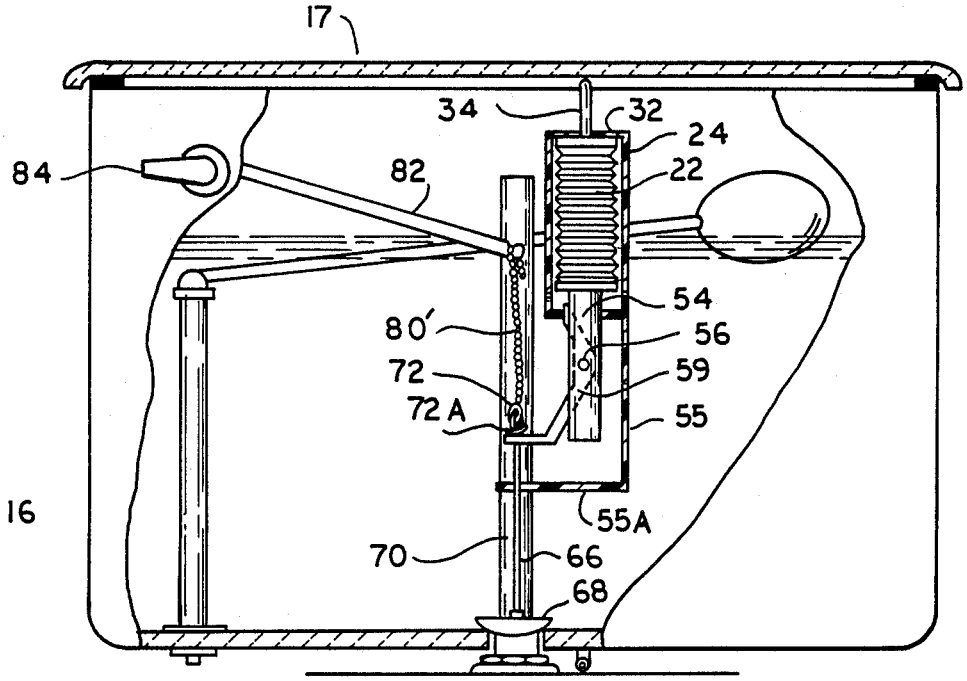
FIG. 4 is a cut away view of the present invention in combination with a manual flushing mechanism.

As can be seen in FIG. 4, the device of the present invention does not interfere with the manual flushing of toilets on occasions when the toilet seat is not used. FIG. 4 shows chain 80 connecting eye hook 72 to lever arm 82, which in turn is connected to flush lever 84. On occasions when the toilet seat is not used, the toilet can be flushed in the usual manner by depressing flush lever 84.

Figure 5:
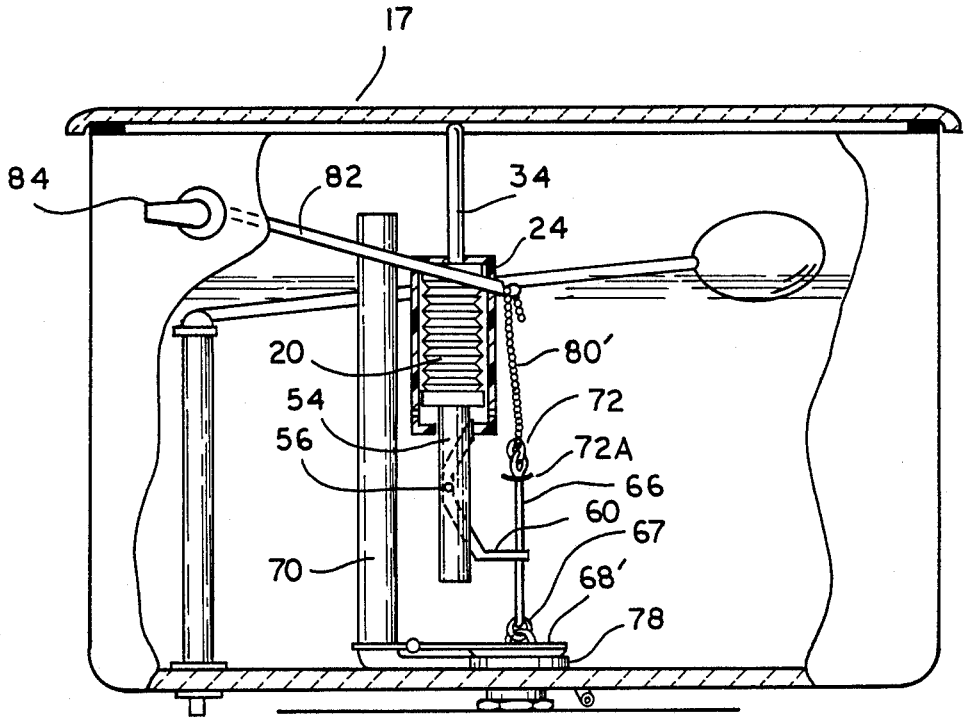
FIG. 5 is a side view of the present invention adapted for use with a flapper type valve.

Although the preceding discussion has illustrated the use of the present invention with a flush valve assembly of the ball-and-rod type, it is equally adaptable to a flapper-type valve assembly. FIG. 5 shows a flapper valve 68' attached to overflow pipe 70 and seated in flush tank drain 78. In order to use the present invention when the flapper valve, an attachment 67 is screwed on to the end of a conventional flush ball rod 66 to enable it to attach to flapper valve 68'. Thus when flush rod 66 is lifted by forked member 60 of crank 56, flapper valve 68' will unseat.

What is claimed is:

1. In an automatic flushing mechanism for a toilet having a commode, a commode seat, a flush tank on the commode, a drain in the base of the flush tank, and valve means for said drain, the improvement comprising:

an air bag disposed intermediate said commode seat and said commode and adapted to expel air upon the placement of weight upon said commode seat;

an air bellows vertically disposed within said flush tank and downwardly expansible therewithin;

an air conduit connecting said air bag and said air bellows;

actuating means operable upon expansion and contraction of said bellows to unseat said drain valve means as a user sits upon then arises from said seat; and wherein, said actuation means comprises;

a shaft depending from said bellows and falling and rising with the expansion and contraction of said bellows;

an angled member pivotally attached to said vertical shaft and having an upper arm and a lower arm;

guide means adapted to urge said upper arm toward a position parallel to said vertical shaft as said vertical shaft falls and to urge said lower arm toward a position parallel to said vertical shaft as said vertical shaft rises;

engaging means at the distal end of said lower arm adapted to engage said drain valve means as said vertical shaft falls and to unseat then release said drain valve means as said vertical shaft rises.

2. The apparatus of claim 1 wherein said air bag is adapted to resume its original shape upon the removal of weight from said commode seat.

3. The apparatus of claim 1 wherein said bellows is contained within a housing, said housing having a bottom and an aperture therewithin to accommodate said vertical shaft, said aperture having a top edge and a bottom edge, and wherein said guide means comprises said top edge and said bottom edge.

4. The apparatus of claim 1 wherein said engaging means comprises a forked member having tines.

5. The apparatus of claim 1 wherein said vertical shaft has a longitudinal channel, said angled member being pivotally mounted within said longitudinal channel.

* * * * *